US011060275B2

(12) United States Patent
Kucera

(10) Patent No.: US 11,060,275 B2
(45) Date of Patent: Jul. 13, 2021

(54) EMBEDDED ANCHORS FOR USE IN MOUNTING PANELS TO OTHER STRUCTURES

(71) Applicant: David M. Kucera, New Paltz, NY (US)

(72) Inventor: David M. Kucera, New Paltz, NY (US)

( * ) Notice: Subject to any disclaimer, the term of this patent is extended or adjusted under 35 U.S.C. 154(b) by 0 days.

(21) Appl. No.: 16/948,737

(22) Filed: Sep. 30, 2020

(65) Prior Publication Data

US 2021/0123232 A1 Apr. 29, 2021

Related U.S. Application Data

(60) Provisional application No. 62/927,570, filed on Oct. 29, 2019.

(51) Int. Cl.

| | |
|---|---|
| ***E04B 1/41*** | (2006.01) |
| ***E04F 13/08*** | (2006.01) |
| ***E04F 13/14*** | (2006.01) |
| ***E04B 1/04*** | (2006.01) |

(Continued)

(52) U.S. Cl.

CPC ..... *E04B 1/41* (2013.01); *E04B 1/043* (2013.01); *E04B 1/215* (2013.01); *E04F 13/0816* (2013.01); *E04F 13/14* (2013.01); *E04F 13/22* (2013.01); *E04B 2103/02* (2013.01)

(58) Field of Classification Search

CPC ..... E04B 1/7637; E04B 1/41; E04B 1/215; E04B 1/043; E04B 1/4114; E04B 2001/405; E04F 13/22

See application file for complete search history.

(56) References Cited

U.S. PATENT DOCUMENTS 1,924,724 A * 8/1933 Olney ..... E04B 2/8652 52/379
5,987,830 A * 11/1999 Worley ..... E04B 1/41 249/190

(Continued)

FOREIGN PATENT DOCUMENTS

CA 3006818 A1 * 11/2018 ..... E04B 1/215
CN 108442537 A * 8/2018
FR 3062146 A1 * 7/2018 ..... E04G 21/185

*Primary Examiner* — Jessie T Fonseca

(74) *Attorney, Agent, or Firm* — Law Offices of Michael L. Wise, LLC

(57) ABSTRACT

Improved designs for embedded anchors that may be utilized to attach panels to other structures are described. An anchor includes a chassis and a leg. The chassis defines a mounting plate with a top surface and a downturned edge region projecting from the mounting plate in a direction substantially normal to the top surface. The bonding leg projects from the downturned edge region and is narrower than the downturned edge region. The bonding leg defines a proximal bonding leg region projecting from the downturned edge region in a direction normal to the top surface that transitions through a curved intermediate bonding leg region into a distal bonding leg region projecting from the curved intermediate bonding leg region in a direction parallel to the top surface. These anchors are easy and economical to manufacturer, and also provide a strong structural bond with panels due to the anchors' unique designs.

19 Claims, 3 Drawing Sheets

(51) Int. Cl.
*E04B 1/21* (2006.01)
*E04F 13/22* (2006.01)

(56) References Cited

U.S. PATENT DOCUMENTS

| | | | | |
|---|---|---|---|---|
| 6,494,639 | B1 * | 12/2002 | Friend | E04B 1/043 403/403 |
| 10,370,845 | B2 * | 8/2019 | Francies, III | E04B 1/483 |
| 2002/0078657 | A1 * | 6/2002 | Zambelli | E04B 1/4107 52/710 |
| 2005/0066613 | A1 * | 3/2005 | Bourque | E04B 1/2612 52/712 |
| 2010/0307094 | A1 * | 12/2010 | Spyrou | E04B 1/40 52/489.1 |
| 2012/0285111 | A1 * | 11/2012 | Johnson, III | E04B 1/4178 52/379 |
| 2014/0075856 | A1 * | 3/2014 | Hohmann, Jr. | E04B 1/4178 52/167.1 |
| 2014/0174013 | A1 * | 6/2014 | Hohmann, Jr. | E04B 1/046 52/565 |
| 2014/0259970 | A1 * | 9/2014 | Shapiro | E04B 1/7629 52/27 |
| 2015/0184383 | A1 * | 7/2015 | Foderberg | B29C 39/10 52/405.1 |
| 2018/0142470 | A1 * | 5/2018 | Stahl, Jr. | E04B 2/88 |
| 2020/0263370 | A1 * | 8/2020 | Tryon | G10K 11/16 |
| 2020/0318341 | A1 * | 10/2020 | Jablonsky | E04B 1/4114 |

* cited by examiner

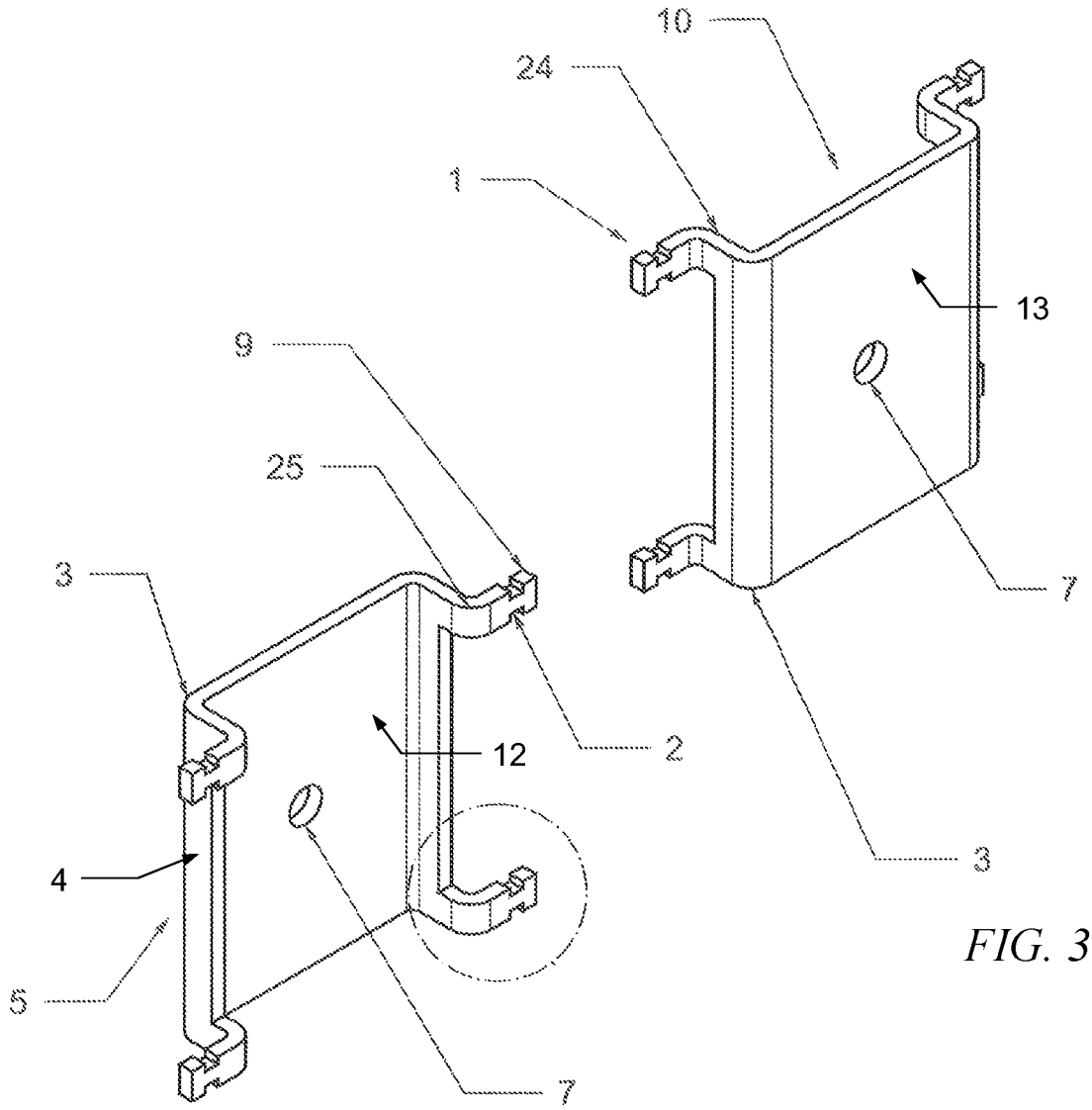
FIG. 3
FIG. 2
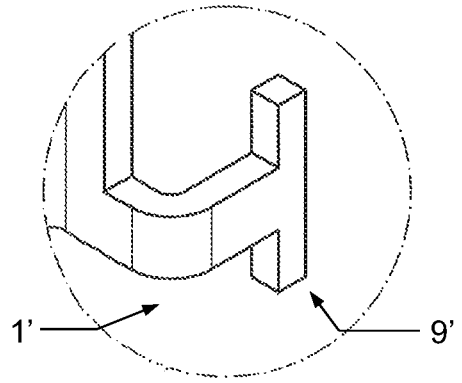
FIG. 5

EMBEDDED ANCHORS FOR USE IN MOUNTING PANELS TO OTHER STRUCTURES

FIELD OF THE INVENTION

The present invention relates generally to apparatus for use in building construction, and, more particularly, to embedded anchors for use in mounting panels on buildings.

BACKGROUND OF THE INVENTION

Embedded concrete anchors are used as connection points for moving, placing, mounting, as well as attachment points for various post-installation assemblies. As concrete is being poured, various reinforcement means, e.g., rebar, mesh, fibers, etc., can typically be used to strengthen the concrete structure. A concrete anchor can be embedded into the concrete, which, after curing of the concrete, can allow for the attachment of various assemblies into the anchor so as to facilitate the desired function. For example, threaded nuts or hooks can be embedded into the concrete and, upon curing and setting of the concrete, can then become immobile and allow for interfacing with the anchor, such as threading a corresponding threaded rod into the embedded nut, or attaching a strap or hoist onto the hook. In addition, the concrete anchor system can include a strap which can interface with the anchor and can be used to attach to the concrete structure and maintain the position of the concrete panel position within a building structure after placement.

Unfortunately, presently available post-installed undercut anchors have historically provided limited pull off strength because they rely on a small point load distribution rather than a broader distributed embed. There is, as a result, a need for solutions that address these shortcomings.

SUMMARY OF THE INVENTION

Embodiments of the present invention address the above-identified needs by providing improved designs for embedded anchors that may be utilized to attach panels to other structures.

Aspects of the invention are directed to an apparatus comprising a chassis and a leg. The chassis defines a mounting plate with a top surface and a downturned edge region projecting from the mounting plate in a direction substantially normal to the top surface. The bonding leg projects from the downturned edge region and is narrower than the downturned edge region. The bonding leg defines a proximal bonding leg region projecting from the downturned edge region in a direction substantially normal to the top surface that transitions through a curved intermediate bonding leg region into a distal bonding leg region projecting from the curved intermediate bonding leg region in a direction substantially parallel to the top surface.

Anchor embodiments in accordance with aspects of the invention provide a versatile means by which to attach panels to other structures such as buildings. These anchors are both easy and economical to manufacturer. At the same time, these anchors provide a strong structural bond with panels due to the anchors' unique design.

BRIEF DESCRIPTION OF THE DRAWINGS

These and other features, aspects, and advantages of the present invention will become better understood with regard to the following description and accompanying drawings where:

FIGS. 2 and 3 are perspective rear and front views, respectively, of the FIG. 1 anchor;

FIG. 5 shows a perspective view of a leg portion of an anchor in accordance with an alternative illustrative embodiment of the invention.

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

As used herein and in the appended claims, the term "substantially normal" means within an angle of ninety plus or minus ten degrees. The term "substantially parallel" means parallel within plus or minus ten degrees.

Figure 1:
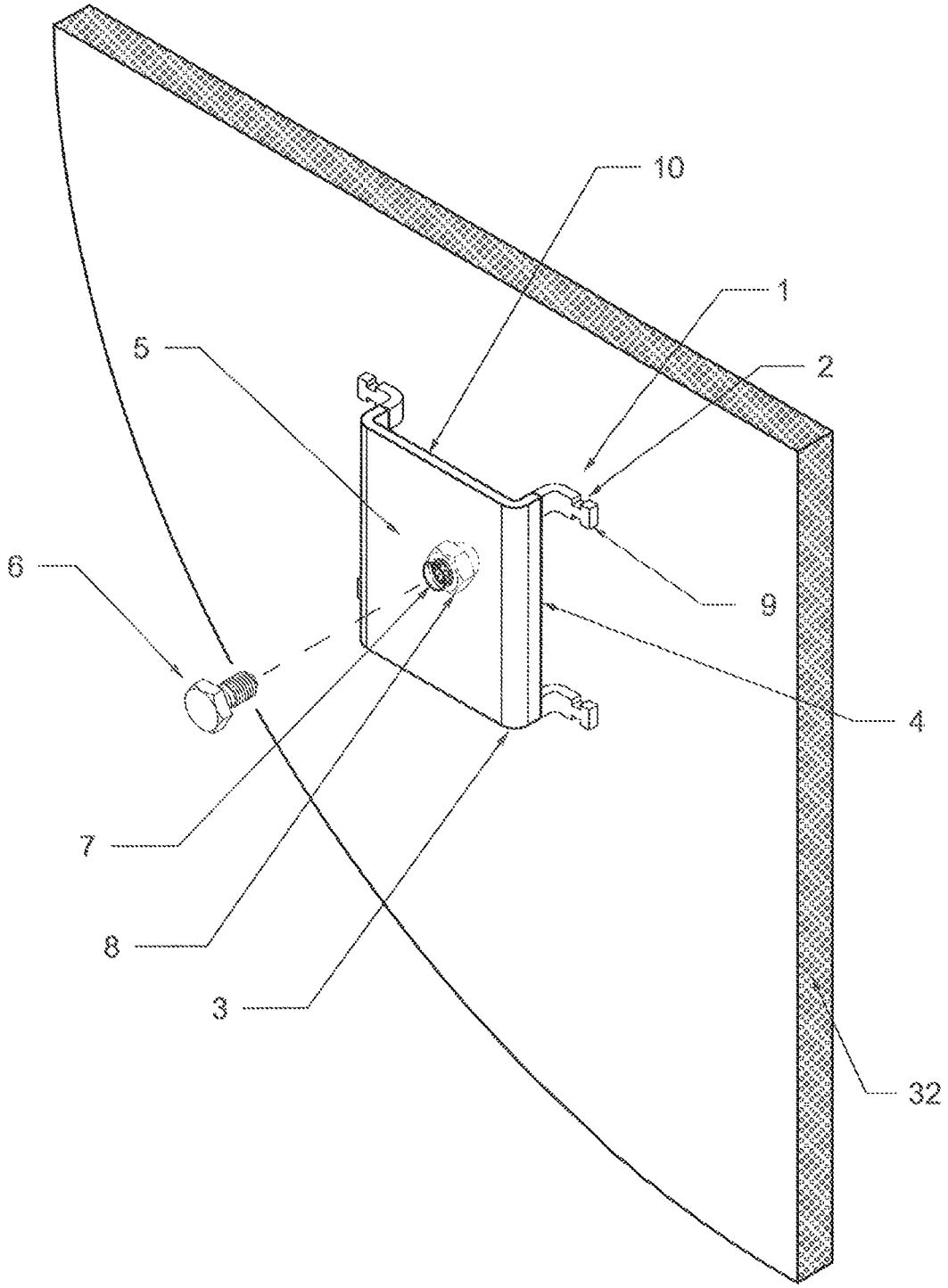
FIG. 1 is a perspective view of an anchor embedded in a fiber cement panel, in accordance with an illustrative embodiment of the invention.

An anchor for use in mounting a panel of fiber cement board or similar to another structure is now described. FIG. 1 shows a perspective view of an anchor 5 embedded in a panel 32 of fiber cement board, in accordance with an illustrative embodiment of the invention. The anchor 5 includes a chassis 10 and four bonding legs 1 that are embedded into the panel 32. A bore 7 in the center of the chassis 7 allows for a bolt 6 and a nut 8 connection to external mounting hardware. The anchor 5 thereby becomes a convenient and versatile means by which to mount the panel 32 to, for example, a building structure.

Additional aspects of the anchor 5 are shown in FIGS. 2 and 3, with FIG. 2 showing a rear perspective view, and FIG. 3 showing a front perspective view. The chassis 10 includes a mounting plate 12 with a top surface 13 and two downturned edge regions 4 that project from the mounting plate 12 in a direction substantially normal to the top surface 13. Curved interfacial edge regions 3 form interfaces between the mounting plate 12 and the downturned edge regions 4. At the same time, four of the bonding legs 1 project from the chassis 10: two bonding legs 1 from one of the downturned edge regions 4, and two bonding legs 1 from the other downturned edge region 4. Each bonding leg 1 is narrower than its corresponding downturned edge region 4. Moreover, each bonding leg 1 defines a respective proximal bonding leg region 24 projecting from its downturned edge region 4 in a direction substantially normal to the top surface 13 that transitions through a respective curved intermediate bonding leg region 25 into a respective distal bonding leg region 9 projecting from its curved intermediate bonding leg region 25 in a direction substantially parallel to the top surface 13. Each distal bonding leg region 9 includes two respective notches 2 therein with each of the two notches 2 occupying opposite sides of that distal bonding leg region 9.

The anchor 5 is preferably formed of a single piece of the same material for both integrity and ease of manufacture. Suitable materials may include, as just a few examples, a metal such as stainless or galvanized steel, plastic, or a composite. If the anchor 5 is formed of metal, manufacture of the anchor 5 may be performed by, for example, punching and crimping a plate of the metal. Manufacture in this manner imparts the anchor 5 with its distinctive filleted edges, namely the curved interfacial edge regions 3 and the curved intermediate bonding leg regions 25. These metal forming techniques will be familiar to one having ordinary skill in the relevant manufacturing arts. These manufacturing processes are also described in a number of readily available references, including, as just one example, H. E. Theis (ed.), *Handbook of Metalforming Processes*, Taylor and Francis, 1999, which is hereby incorporated by reference herein. That said, it should also be understood that while the anchor 5 is illustrated as being formed from a single sheet of material, it is not so limited and could be constructed in a similar design from multiple pieces of welded or otherwise joined parts.

The bore 7 is located approximately in the center of the mounting plate 12 and allows mechanical fasteners to be utilized to attach the anchor 5 and panel 32 to auxiliary mounting hardware or directly to a building structure. That is, a fastener can be made to pass through the bore 7 for purposes of the fixation. The bore 7 can be smooth or threaded depending on installation requirements. In alternative embodiments, more than one bore may also be included.

In this manner, aspects of the invention relate to an anchor 5 that may be embedded in a panel 32 of some kind (e.g., one formed of concrete). The anchor 5 comprises a symmetrical array of bonding legs 1 extending from the body of the anchor 5 at an approximate ninety-degree angle and being L-shaped in profile. The portion of the L that does not connect to the body of the anchor 5 is symmetrically notched one or more times and is embedded in the panel 32 in a plane parallel with an external surface of the panel 32. The top surface 13 of the mounting plate 12 is also substantially parallel to an external surface of the panel 32, but the mounting plate 12 is in spaced relation to the panel 32.

With its notched bonding legs 1 securely embedded in the panel 32 in the manner indicated in FIG. 1, the anchor 5 becomes a convenient and versatile means by which to attach the panel 32 to another structure such as a building. FIG. 3 shows a side view of the anchor 5 and the panel 32 with a C-shaped hanger rail 18 and a C-shaped receiving rail 17 attached to a mounting bracket 19 with a self-tapping screw 20. The anchor 5 is fastened to the C-shaped hanger rail 18 with a threaded hex bolt 22 and an acorn nut 23. The anchor 5, panel 32, and hanging rail 18 assembly is interlocked and screwed onto the receiving C-shaped rail 17 and is preferably leveled on site with a leveling bolt 21 to ensure that consecutive panel assemblies are level to each other and plum. Suitable rail-and-bracket mounting assemblies like those shown are commercially available from, for example, NVELOPE Rainscreen Systems Ltd. (Hertfordshire, UK)

The anchor 5 may thereby be structurally bonded to a fiber cement board panel 32 through the process of embedding the notched bonding legs 1 of the anchor 5 into the panel 32 while the concrete is uncured. In so doing, the symmetrical notches on the bonding legs 1 increase the surface area of the embedded bonding legs 1, which increase the strength of the structural bond to the panel 32. The number of notched bonding legs as well, as their unique design, thereby combine to provide a strong positive structural bond with the panel 32 with greater pull-off strengths than many prior-art dry-set, undercut anchor designs.

Embodiments of the invention may be particularly well suited to embedded anchors for mounting and assembly of facade rainscreen cladding systems constructed from lightweight fiber-reinforced concrete panels mechanically fastened to a variety of rail-and-bracket mounting assemblies, themselves fastened to direct members or auxiliary components of a building's exterior structural system. However, the invention is in no way limited to this particular application. For example, while the invention is described in relation to the anchor 5 being cast in the fiber-reinforced concrete panel 32, it may have similar applicability in other construction implementations related to construction, masonry, cladding, casting, and similar.

Aspects of the invention thereby provide several important advantages over prior art designs and provide a significant technical advancement over conventional dry-set undercut anchors. Anchors in accordance with aspects of the invention are firstly both easy and economical to manufacturer. At the same time, these anchors provide a strong structural bond with a panel due to the anchors' unique designs. Lastly, the anchors provide a versatile means by which to attach panels to other structures such as buildings. A variety of rail, bracket, and other architectural hardware assemblies may be utilized, or anchors may even be supported directly by a building's vertical structure.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

Figure 4:
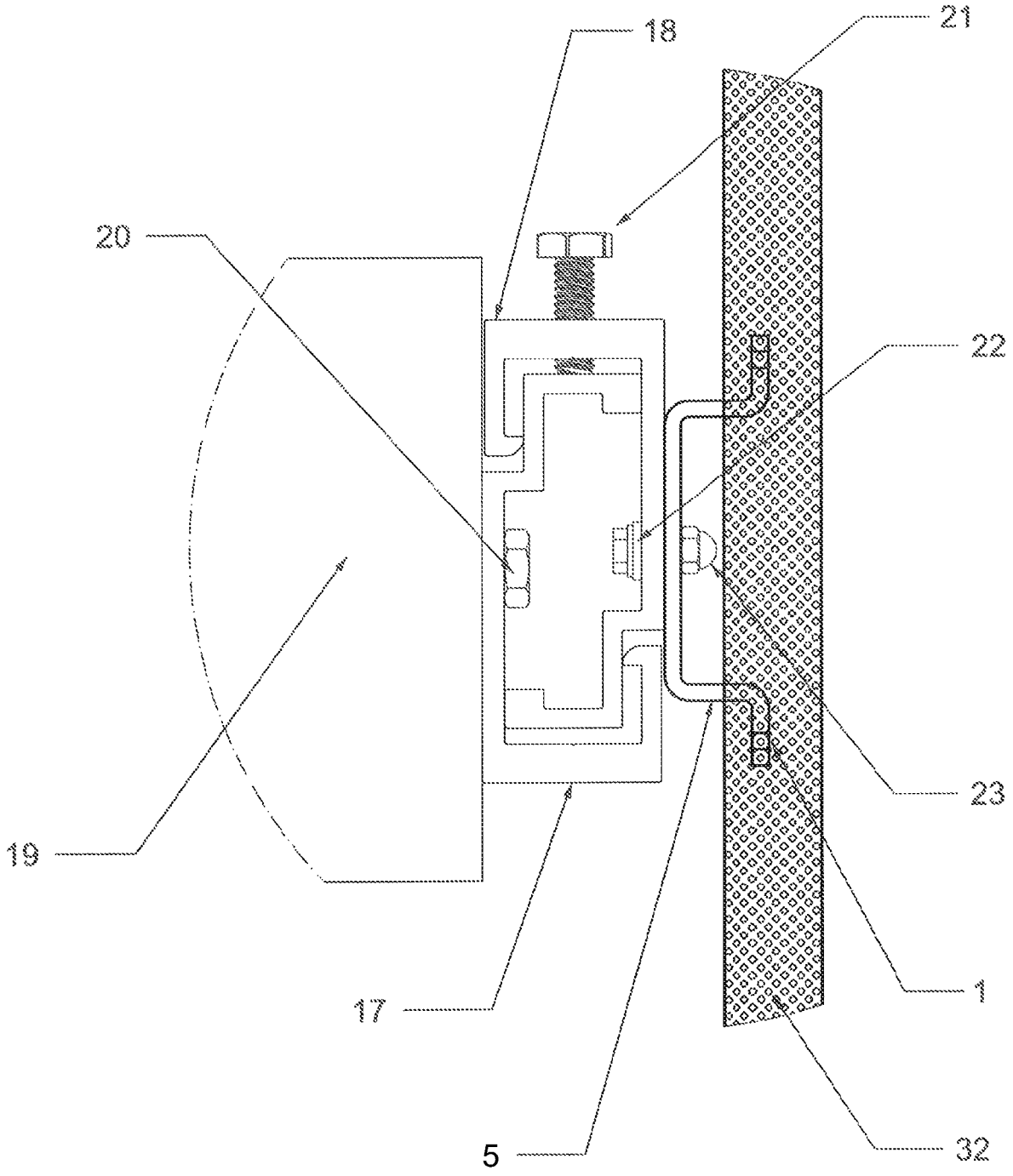
FIG. 4 is a side view of the FIG. 1 anchor fastening a panel to an adjoining bracket-and-rail mounting system.

For example, while the anchor 5 and the panel 32 are illustrated as being held in place in FIG. 4 by interlocking C-shaped mounting hardware 17,18 and the mounting bracket 19, it is not so limited and can be supported directly by a building's vertical structure or a variety of rail, bracket, and other architectural hardware assemblies. Moreover, while the anchor 5 is illustrated with a threaded hex bolt 22 and acorn nut 23 fastening assembly, it can alternatively be fastened with a bolt, screw, pin, rivet, or other similar hardware fastener. A strap may also be utilized.

In one or more alternative embodiments falling within the scope of the invention, the mounting plate of an anchor may have a shape that is not a parallelogram (e.g., is not square or rectangular) and/or may have more than one bore. These bores can be smooth or threaded depending on the hardware and structural requirements of a specific implementation. In even other embodiments, a bore may be replaced by a J-hook. Fewer or greater than four bonding legs may also be utilized.

In even other embodiments, the bonding legs of an anchor may be shaped differently from those shown in FIGS. 1-4. FIG. 5 shows a perspective view of a portion of an alternative bonding leg 1'. The alternative bonding leg 1' does not have symmetrical notches 2 in the manner of the previous bonding leg 1. Instead, a distal bonding leg region 9' of the alternative bonding leg 1' is shaped like a T. The size of the symmetrical extensions of the T can be readily modified to provide the desired bonding strengths for the specific application.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus comprising:

a chassis defining a mounting plate with a top surface and a downturned edge region projecting from the mounting plate in a direction substantially normal to the top surface;

a first bonding leg projecting from the downturned edge region, the first bonding leg narrower than the downturned edge region and defining a first proximal bonding leg region projecting from the downturned edge region in a direction substantially normal to the top surface that transitions through a first curved intermediate bonding leg region into a first distal bonding leg region projecting from the first curved intermediate bonding leg region in a direction substantially parallel to the top surface; and a second bonding leg projecting from the downturned edge region in spaced relation to the first bonding leg, the second bonding leg narrower than the downturned edge region and defining a second proximal bonding leg region projecting from the downturned edge region in a direction substantially normal to the top surface that transitions through a second curved intermediate bonding leg region into a second distal bonding leg region projecting from the second curved intermediate bonding leg region in a direction substantially parallel to the top surface;

wherein the downturned edge region is continuous between the first bonding leg and the second bonding leg.

2. The apparatus of claim 1, wherein the chassis, the downturned edge region, the first bonding leg, and the second bonding leg are formed from a single continuous piece of the same material.

3. The apparatus of claim 1, wherein the single continuous piece of the same material comprises a metal.

4. The apparatus of claim 3, wherein the metal comprises steel.

5. The apparatus of claim 1, further comprising a curved interfacial edge region between the downturned edge region and the mounting plate.

6. The apparatus of claim 1, wherein the first distal bonding leg region defines a pair of notches therein.

7. The apparatus of claim 6, wherein the pair of notches occupy opposite sides of the first distal bonding leg region.

8. The apparatus of claim 1, wherein the first distal bonding leg region is T-shaped.

9. The apparatus of claim 1, further comprising:

a second downturned edge region projecting from the mounting plate in a direction substantially normal to the top surface; and a third bonding leg projecting from the second downturned edge region, the third bonding leg narrower than the second downturned edge region and defining a third proximal bonding leg region projecting from the second downturned edge region in a direction substantially normal to the top surface that transitions through a third curved intermediate bonding leg region into a third distal bonding leg region projecting from the third curved intermediate bonding leg region in a direction substantially parallel to the top surface;

wherein the downturned edge region and the second downturned edge region are in spaced relation.

10. The apparatus of claim 1, further comprising a panel, wherein at least a portion of the first bonding leg is embedded in the panel.

11. The apparatus of claim 10, wherein the panel comprises concrete.

12. The apparatus of claim 10, wherein the top surface is substantially parallel to an external surface of the panel.

13. The apparatus of claim 10, wherein the mounting plate is in spaced relation to the panel.

14. The apparatus of claim 10, further comprising a building, wherein the chassis and the first bonding leg contribute in attaching the panel to the building.

15. The apparatus of claim 1, wherein the mounting plate defines a bore passing therethrough.

16. The apparatus of claim 15, further comprising:

a fastener passing through the bore; and a mounting assembly fixated to the mounting plate by the fastener.

17. The apparatus of claim 16, wherein the mounting assembly comprises:

a hanger rail; and a receiving rail attached to the hanger rail.

18. The apparatus of claim 16, wherein the fastener comprises a bolt.

19. The apparatus of claim 9, further comprising a fourth bonding leg projecting from the second downturned edge region in spaced relation to the third bonding leg, the fourth bonding leg narrower than the second downturned edge region and defining a fourth proximal bonding leg region projecting from the second downturned edge region in a direction substantially normal to the top surface that transitions through a fourth curved intermediate bonding leg region into a fourth distal bonding leg region projecting from the fourth curved intermediate bonding leg region in a direction substantially parallel to the top surface;

wherein the second downturned edge region is continuous between the third bonding leg and the fourth bonding leg.

* * * * *